United States Patent [19]

Andeen et al.

[11] Patent Number: 4,718,240

[45] Date of Patent: Jan. 12, 1988

[54] CRYOPUMP REGENERATION METHOD AND APPARATUS

[75] Inventors: Bruce R. Andeen, Acton; Robert C. Pandorf, Newton Highlands, both of Mass.

[73] Assignee: Helix Technology Corporation, Waltham, Mass.

[21] Appl. No.: 4,300

[22] Filed: Jan. 7, 1987

Related U.S. Application Data

[63] Continuation of Ser. No. 707,467, Mar. 1, 1985, abandoned.

[51] Int. Cl.[4] ..... B01D 8/00

[52] U.S. Cl. ..... 62/55.5; 55/269; 62/100; 62/116; 62/268; 62/500; 417/901

[58] Field of Search ..... 62/55.5, 100, 116, 268, 62/500; 417/901; 55/269

[56] References Cited

U.S. PATENT DOCUMENTS

| | | | |
|---|---|---|---|
| 3,216,214 | 11/1965 | Gasbarro | 62/268 |
| 3,279,198 | 10/1966 | Ayers et al. | 62/45 |
| 3,371,499 | 3/1968 | Hagebach et al. | 62/55.5 |
| 3,630,051 | 12/1971 | Martin | 62/55.5 |
| 3,965,689 | 6/1976 | Brown et al. | 62/50 |
| 4,356,701 | 11/1982 | Bartlett et al. | 62/55.5 |
| 4,438,632 | 3/1984 | Lessard et al. | 62/55.5 |
| 4,446,702 | 5/1984 | Peterson et al. | 62/55.5 |
| 4,454,722 | 6/1984 | Bartlett et al. | 62/55.5 |
| 4,577,465 | 3/1986 | Olsen et al. | 62/55.5 |

FOREIGN PATENT DOCUMENTS

| | | |
|---|---|---|
| 1380205 | 10/1964 | France . |
| 652804 | 11/1985 | Switzerland . |

OTHER PUBLICATIONS

*Solid State Technology*, vol. 25, No. 1, Jan. 1982, (Port Washington, US), J. F. Peterson et al.: "Vacuum Pump Technology; a Short Course on Theory and Operations", pp. 104–110, see p. 107, Right-Hand Column, Paragraph Regeneration—p. 108, Right-Hand Column, Paragraph 1.

*Primary Examiner*—Ronald C. Capossela

*Attorney, Agent, or Firm*—Hamilton, Brook, Smith & Reynolds

[57] ABSTRACT

A cryopump is regenerated by means of an ejector pump which draws gas from the cryopump as the pump is warmed. The ejector is actuated by an inert gas. The same inert gas may also be used to purge the pump during evacuation.

10 Claims, 1 Drawing Figure

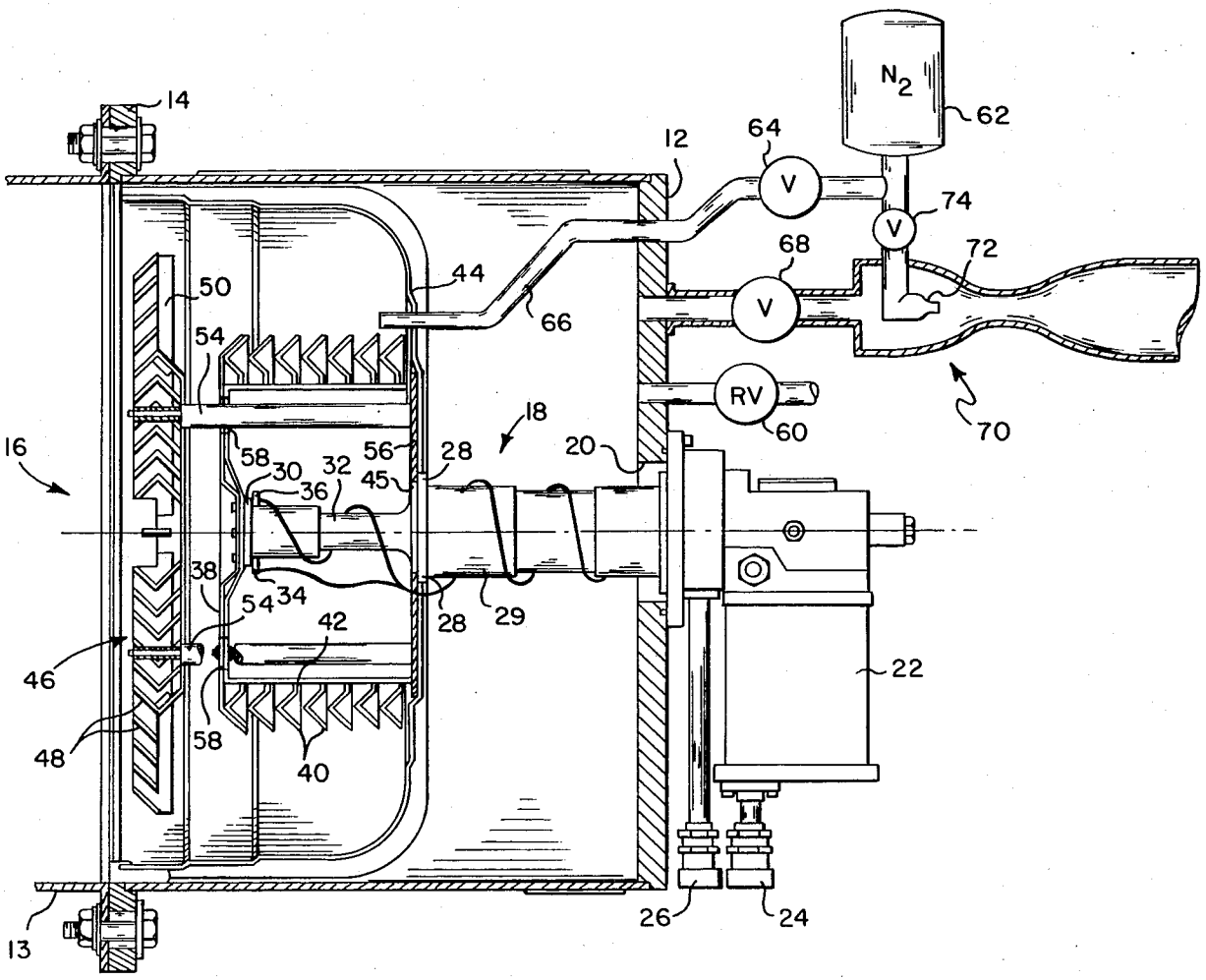
$N_2$
V
V
V
RV
12
13
14
16
18
20
22
24
26
28
29
30
32
34
36
38
40
42
44
45
46
48
50
54
56
58
60
62
64
66
68
70
72
74

CRYOPUMP REGENERATION METHOD AND APPARATUS

This is a continuation of copending application Ser. No. 707,467 filed on Mar. 1, 1985 now abandoned.

DESCRIPTION

1. Technical Field

This invention relates to the regeneration of cryopumps.

2. Background

Cryopumps currently available, whether cooled by open or closed cryogenic cycles, generally follow the same design concept. A low temperature array, usually operating in the range of 4 to 25 K., is the primary pumping surface. This surface is surrounded by a higher temperature radiation shield, usually operated in the temperature range of 70 to 130 K., which provides radiation shielding to the lower temperature array. The radiation shield generally comprises a housing which is closed except at a frontal array positioned between the primary pumping surface and the chamber to be evacuated. This higher temperature, first stage frontal array serves as a pumping site for higher boiling point gases such as water vapor.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, only a vacuum remains in the work chamber.

In systems cooled by closed cycle coolers, the cooler is typically a two stage refrigerator having a cold finger which extends through the rear of the radiation shield. The cold end of the second, coldest stage of the cryocooler is at the tip of the cold finger. The primary pumping surface, or cryopanel, is connected to a heat sink at the coldest end of the second stage of the cold finger. This cryopanel may be a simple metal plate or an array of metal baffles arranged around and connected to the second stage heat sink. This second stage cryopanel also supports the low temperature adsorbent.

The radiation shield is connected to a heat sink, or heat station at the coldest end of the first stage of the refrigerator. The shield surrounds the second stage cryopanel in such a way as to protect it from radiant heat. The frontal array is cooled by the first stage heat sink through the side shield or, as disclosed in U.S. Pat. No. 4,356,701, through thermal struts.

After several days or weeks of use, the gases which have condensed onto the cryopanels, and in particular the gases which are adsorbed, begin to saturate the system. A regeneration procedure must then be followed to warm the cryopump and thus release the gases and remove the gases from the system. As the gases evaporate, the pressure in the cryopump increases. Typically, the gases are exhausted from the cryopump at about 18 pounds per square inch (PSIA). During regeneration, the cryopump is often purged with warm nitrogen gas. The nitrogen gas hastens warming of the cryopanels and also serves to flush water and other vapors from the system. By directing the nitrogen into the system close to the second stage array, the nitrogen gas which flows outward to the exhaust port prevents the flow of water vapor from the first stage array back to the second stage array. Nitrogen is the usual purge gas because it is inert. The nitrogen gas dilutes any mixture of combustible gases such as hydrogen and oxygen which may be released by the cryopump.

The adsorbent on the second stage array is generally the component of the system which first requires regeneration. Thus, to increase the operating time of a cryopump between required periods of regeneration the amount of adsorbent carried by the second stage is increased. However, an increased amount of adsorbent increases the amount of hydrogen which can be collected by the system and thus also increases the danger due to combustion of the hydrogen during regeneration.

DISCLOSURE OF THE INVENTION

In accordance with the present invention, gases which evaporate during regeneration are evacuated from the cryopump by means of an ejector pump. By the use of an inert gas such as nitrogen to actuate the ejector pump, any released inflammable gas may be further diluted with inert gas to minimize the danger of combustion external to the vacuum vessel. Also, by first removing the released hydrogen gas from the system, the amount of hydrogen which mixes with the later evaporated oxygen in the cryopump is substantially reduced. Further, by reducing the pressure of the cryopump chamber the system may be held, in the unlikely event of combustion within the chamber, to acceptable pressure levels.

BRIEF DESCRIPTION OF THE DRAWINGS

The foregoing and other objects, features and advantages of the invention will be apparent from the following more particular description of a preferred embodiment of the invention, as illustrated in the accompanying drawing. The drawing is not necessarily to scale, emphasis instead being placed on illustrating the principles of the invention. The drawing is a cross sectional view of a cryopump system embodying the present invention.

DESCRIPTION OF A PREFERRED EMBODIMENT

The cryopump of FIG. 1 comprises a main housing 12 which is mounted to a work chamber or a valve housing 13 along a flange 14. A front opening 16 in the cryopump housing 12 communicates with a circular opening in the work chamber or valve housing. Alternatively, the cryopump arrays may protrude into the chamber and a vacuum seal be made at a rear flange. A two stage cold finger 18 of a refrigerator protrudes into the housing 12 through an opening 20. In this case, the refrigerator is a Gifford-MacMahon refrigerator but others may be used. A two stage displacer in the cold finger 18 is driven by a motor 22. With each cycle, helium gas introduced into the cold finger under pressure through line 26 is expanded and thus cooled and then exhausted through line 24. Such a refrigerator is disclosed in U.S. Pat. No. 3,218,815 to Chellis et al. A first stage heat sink, or heat station 28 is mounted at the cold end of the first stage 29 of the refrigerator. Similarly, a heat sink 30 is mounted to the cold end of the second stage 32. Suitable temperature sensor and vapor pressure sensor elements 34 and 36 are mounted to the rear of the heat sink 30.

The primary pumping surface is a cryopanel array mounted to the heat sink 30. This array comprises a disc 38 and a set of circular chevrons 40 arranged in a vertical array and mounted to disc 38. The cylindrical surface 42 holds a low temperature adsorbent. Access to this adsorbent by low boiling point gases is through chevrons.

A cup shaped radiation shield 44 is mounted to the first stage, high temperature heat sink 28. The second stage of the cold finger extends through an opening 45 in that radiation shield. This radiation shield 44 surrounds the primary cryopanel array to the rear and sides to minimize heating of the primary cryopanel array by radiation. The temperature of this radiation shield ranges from about 100° K. at the heat sink 28 to about 130° K. adjacent to the opening 16.

A frontal cryopanel array 46 serves as both a radiation shield for the primary cryopanel array and as a cryopumping surface for higher boiling temperature gases such as water vapor. This panel comprises a circular array of concentric louvers and chevrons 48 joined by spoke-like plates 50. The configuration of this cryopanel 46 need not be confined to circular concentric components; but it should be so arranged as to act as a radiant heat shield and a higher temperature cryopumping panel while providing a path for lower boiling temperature gases to the primary cryopanel.

Thermal struts 54 extend between a plate 56 mounted to the heat sink 28 and the frontal array. Those struts extend through clearance openings 58 in the primary panel 38 and are thus isolated from that panel.

In a typical system, the cryopump is regenerated by turning off the refrigerator and allowing the system to warm. As the temperature of the system increases the gases evaporate thus increasing the pressure in the system. As the pressure reaches about 18 PSIA the released gases are exhausted from the system through a relief valve 60. To assist in warming the cryopump to dry the system of water vapor, and to dilute any combustible gases in the system, a warm inert gas such as nitrogen may be introduced from a supply 62 through a valve 64 and a purge port 66. Preferably, the purge port releases the nitrogen near to the second stage array to minimize the back flow of water vapor from the first stage array to the second stage. The use of a mechanical roughing pump during this stage of regeneration should be used with caution to prevent backstreaming of oil which would contaminate the adsorbent. After the system is warmed to ambient temperature a rough pump can be utilized to reduce the pressure in the system before turning on the refrigerator for continued cryopumping operation.

In accordance with the present invention, gas which is released from the cryopump during regeneration is removed rapidly from the system through a valve 68 by means of an ejector 70. An ejector, also referred to as jet pump or venturi pump, aspirates the gas from the cryopump chamber by means of a high velocity jet of fluid from a nozzle 72 or some other venturi for generating high velocity flow. Preferably, the actuating fluid forced through the nozzle 72 is nitrogen gas valved through a valve 74 from the nitrogen supply 62. Nitrogen gas is inert, that is it does not react with the hydrogen or oxygen in the system. The nitrogen thus further dilutes the hydrogen and oxygen which is aspirated from the cryopump. An alternative ejector in which the aspirated fluid is drawn through a side port in a venturi is the Ultravak TM air ejector available from Air-Vak Engineering Co., Inc., Milford, Conn.

In addition to diluting the exhausted hydrogen and oxygen gas, the present system serves to minimize the danger of any combustion in the cryopump housing by reducing the pressure. During deflagration, the pressure can increase approximately seven-fold. Thus, if the internal pressure of the cryopump chamber is about 1 atmosphere the pressure can be expected to rise to 7 atmospheres in the event of combustion. On the other hand, by promptly reducing the pressure in the cryopump chamber to about 2 PSIA, the pressure, even with combustion, does not rise above 1 atmosphere. Thus, even in the unlikely event of combustion, the pressure in the vacuum chamber remains at safe levels.

The present system further minimizes the dangers of combustion by reducing the amount of hydrogen and oxygen which are mixed at any given time in the cryopump chamber. During regeneration of a hydrogen saturated cryopump, much of the hydrogen is released from the adsorbent before oxygen is evaporated from the cryopanels. Thus, by evacuating the cryopump chamber as the hydrogen is released, most of the hydrogen can be removed before a significant amount of oxygen is evaporated. By the time a substantial amount of oxygen has evaporated most of the hydrogen has been removed from the system.

Although the nitrogen purge is less necessary with the use of an aspirator, the nitrogen may still be useful in helping to warm the system, to dry the system, and to initially dilute the released gases before they reach the ejector.

While the invention has been particularly shown and described with reference to preferred embodiments thereof, it will be understood by those skilled in the art that various changes in form and details may be made therein without departing from the spirit and scope of the invention as defined by the appended claims.

We claim:

1. A method of regenerating a cryopump comprising warming the cryopump to evaporate or release previously condensed or adsorbed gases and simultaneously evacuating the cryopump with an ejector pump such that the evaporated or released gases are rapidly removed from the cryopump as they are evaporated or released.

2. A method of regenerating a cryopump comprising warming the entire cryopump to evaporate or release previously condensed or adsorbed gases and simultanesouly evacuating the cryopump with an ejector pump actuated by a substantially inert fluid such that the evaporated or released gases are rapidly removed from the cyropump as they are evaporated or released.

3. The method of claim 2 wherein the inert fluid is nitrogen.

4. The method of claim 3 further comprising purging the cryopump with nitrogen gas.

5. The method of claim 2 further comprising purging the cryopump with an inert gas.

6. A vacuum system comprising:

a cryopump for evacuating a chamber;

an ejector pump in direct communication with the cryopump through a valve for removing gas from the cryopump during regeneration; and a source of pressurized, substantially inert gas in communication with the ejector pump for use as the actuating fluid in the ejector pump.

7. A vacuum system as claimed in claim 6 wherein the substantially inert gas is nitrogen.

8. A vacuum system as claimed in claim 7 further comprising means for applying nitrogen gas to the cryopump to purge the cryopump.

9. A vacuum system as claimed in claim 6 further comprising means for applying a purge gas to the cryopump.

10. A method of regenerating a cryopump comprising warming the entire cryopump to evaporate or release previously condensed or absorbed gases and simultaneosuly evacuating the cryopump with an ejector vacuum pump such that the evaporated or released gases are rapidly removed from the cryopump as they are evaporated or released and mixed with an inert gas.

* * * * *